US006358126B1

(12) United States Patent
Jackson et al.

(10) Patent No.: US 6,358,126 B1
(45) Date of Patent: Mar. 19, 2002

(54) POLISHING APPARATUS

(75) Inventors: Robert R. Jackson, Bronxville, NY (US); Tetsuji Togawa, Chigasaki; Satoshi Wakabayashi, Kawasaki, both of (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/576,717

(22) Filed: May 23, 2000

(51) Int. Cl.[7] ..... B24B 7/00
(52) U.S. Cl. ..... 451/65; 451/67; 451/279
(58) Field of Search ..... 451/41, 65, 279, 451/285, 67

(56) References Cited

U.S. PATENT DOCUMENTS 4,944,119 A 7/1990 Gill, Jr. et al.
5,549,502 A * 8/1996 Tanaka et al.
5,649,854 A 7/1997 Gill, Jr.
5,738,574 A 4/1998 Tolles et al.
5,804,507 A 9/1998 Perlov et al.
5,908,347 A * 6/1999 Nakajima et al.
6,062,954 A 5/2000 Izumi

* cited by examiner

*Primary Examiner*—Timothy V. Eley
*Assistant Examiner*—Willie Berry, Jr.
(74) *Attorney, Agent, or Firm*—Wenderoth, Lind & Ponack, L.L.P.

(57) ABSTRACT

A polishing apparatus is used for polishing a workpiece such as a semiconductor wafer to a flat mirror finish. The polishing apparatus includes a turntable having a polishing surface, a top ring for holding a workpiece and pressing the workpiece against the polishing surface to polish the workpiece. The polishing apparatus further includes a rotary transporter disposed in a position which can be accessed by the top ring and having a plurality of stages positioned on a predetermined circumference from a center of rotation of the rotary transporter for holding the workpieces. The polishing apparatus further includes a plurality of support tables removably held by the respective stages of the rotary transporter for supporting the workpieces, and a pusher for transferring the workpiece between the support table and the top ring.

16 Claims, 14 Drawing Sheets

28
101
29
600
(600a)
610
260
260a
27
611
602

32
301
101
600
(600b)
602
610
27
30
143
143a
208
148
700
141

POLISHING APPARATUS

BACKGROUND OF THE INVENTION

1. Field of the Invention:

The present invention relates to a polishing apparatus for polishing a workpiece such as a semiconductor wafer to a flat mirror finish, and more particularly to a polishing apparatus having a rotary transporter for supplying workpieces to a polishing position.

2. Description of the Related Art:

In semiconductor device manufacturing processes, semiconductor wafers are polished to a flat mirror finish in a semiconductor wafer fabrication process, and layers formed on semiconductor devices are polished to a flat mirror finish in a semiconductor device fabrication process. These polishing processes in the semiconductor wafer fabrication process and the semiconductor device fabrication process are performed by a polishing apparatus, called a chemical mechanical polishing apparatus.

Conventionally, such a polishing apparatus has been designed as a dedicated polishing apparatus having a single function of polishing semiconductor wafers. The semiconductor wafers which have been polished by the polishing apparatus are transported to a next cleaning process by a movable water tank containing water in which they are immersed to keep them from drying during transportation. However, this separated polishing and cleaning process tends to impair the cleanliness of a clean room, and the polished semiconductor wafers need to be transported by an operator or a manually operated transportation means. Further, a large installation space is required for two kinds of apparatuses comprising a polishing apparatus and a cleaning apparatus that is used to carry out the subsequent cleaning process.

In an effort to make the polishing process clean and reduce the installation space of the apparatus, there has been developed a polishing apparatus which performs both a polishing process and a cleaning process and which is of a dry-in and dry-out type for introducing semiconductor wafers therein in a dry condition and removing polished and cleaned semiconductor wafers therefrom in a dry condition.

On the other hand, the polishing apparatus having a single function of polishing semiconductor wafers has been improved to allow the cleanliness of a clean room to be maintained, and the polishing apparatus and the cleaning apparatus used in a cleaning process after polishing have an increased processing capability for thereby reducing the number of the polishing apparatuses used for polishing processes and the number of the cleaning apparatuses. As a result, the conventional dedicated polishing apparatus having a single function of polishing semiconductor wafers can reduce an installation space thereof to a degree which is equal to or smaller than the dry-in and dry-out type polishing apparatus.

However, in the dedicated polishing apparatus having a single function of polishing semiconductor wafers, the semiconductor wafers which have been polished by the polishing apparatus are transported still by an operator or a manually operated transportation means, as before. If the transportation means is automated, then it is difficult to handle the semiconductor wafers because the semiconductor wafers are stored in the movable water tank. Thus, the problems are presented by the transportation means in the conventional dedicated polishing apparatus.

Further, the dry-in and dry-out type polishing apparatus has a processing capability per unit time and unit installation area lower than the conventional dedicated polishing apparatus. Thus, the number of apparatuses in the polishing processes is large, a large installation space is required, and the running cost of the apparatuses is high.

SUMMARY OF THE INVENTION

It is therefore an object of the present invention to provide a polishing apparatus which can be used as a dry-in and dry-out type polishing apparatus, and has a high processing capability per unit time and unit installation area for processing workpieces such as semiconductor wafers.

Another object of the present invention is to provide a polishing apparatus which can reduce or minimize the number of times of transfer of a workpiece such as a semiconductor wafer while the workpiece is transported from a reversing device to a top ring.

According to the present invention, there is provided a polishing apparatus comprising: a turntable having a polishing surface; a top ring for holding a workpiece and pressing the workpiece against the polishing surface to polish the workpiece; a rotary transporter disposed in a position which can be accessed by the top ring and having a plurality of stages positioned on a predetermined circumference from a center of rotation of the rotary transporter; a plurality of support tables removably held by the respective stages of the rotary transporter for supporting workpieces respectively; and a pusher for vertically moving the support table and transferring the workpiece between the support table and the top ring.

According to the present invention, it is possible to shorten the time required to transfer a workpiece to be polished, such as a semiconductor wafer, to the top ring, thereby greatly increasing the number of processed workpieces per unit time, i.e. throughput.

In a preferred embodiment, the polishing apparatus further comprises a reversing device for reversing the workpiece; and a lifter for vertically moving the support table and transferring the workpiece between the support table and the reversing device.

Thus, the transfer of a semiconductor wafer as a workpiece to be polished from the reversing device to the top ring can be performed by the wafer support tables removably held by the respective stages of the rotary transporter. Thus, for example, the transfer of the semiconductor wafer between the lifter and the rotary transporter or between the rotary transporter and the pusher may be eliminated to prevent dust from being generated and prevent the semiconductor wafer from being damaged due to transfer error or clamping error.

In a preferred embodiment, a plurality of the support tables comprise a loading support table for holding the workpiece to be polished and an unloading support table for holding the workpiece which has been polished.

With the above arrangement, the semiconductor wafer to be polished is transferred not from the pusher but from the loading wafer support table to the top ring, and the polished semiconductor wafer is transferred from the top ring not to the pusher but to the unloading wafer support table. Thus, the loading of the semiconductor wafer to the top ring, and the unloading of the semiconductor wafer from the top ring are conducted by respective jigs (or components), i.e. the support table, and hence the abrasive liquid or the like attached to the polished semiconductor wafer is prevented from being attached to a common support member for performing loading and unloading of the semiconductor wafer. As a result, the solidified abrasive liquid or the like is not attached to the semiconductor wafer to be polished, and does not cause damage to the semiconductor wafer to be polished.

In a preferred embodiment, the rotary transporter comprises a plurality of guide blocks provided circumferentially at certain intervals on each of the stages for removably holding the support table.

In a preferred embodiment, the guide block has at least one of an inner surface which has a tapered surface for centering action and an outer surface which has a tapered surface for centering action.

With the above arrangement, centering of the support table with respect to the guide blocks can be performed by the tapered surface.

In a preferred embodiment, each of the top rings is angularly movable about a rotating shaft to a position over one of the turntables and a position over one of the stages of the rotary transporter.

The above and other objects, features, and advantages of the present invention will become apparent from the following description when taken in conjunction with the accompanying drawings which illustrate preferred embodiments of the present invention by way of example.

and

Figure 14:
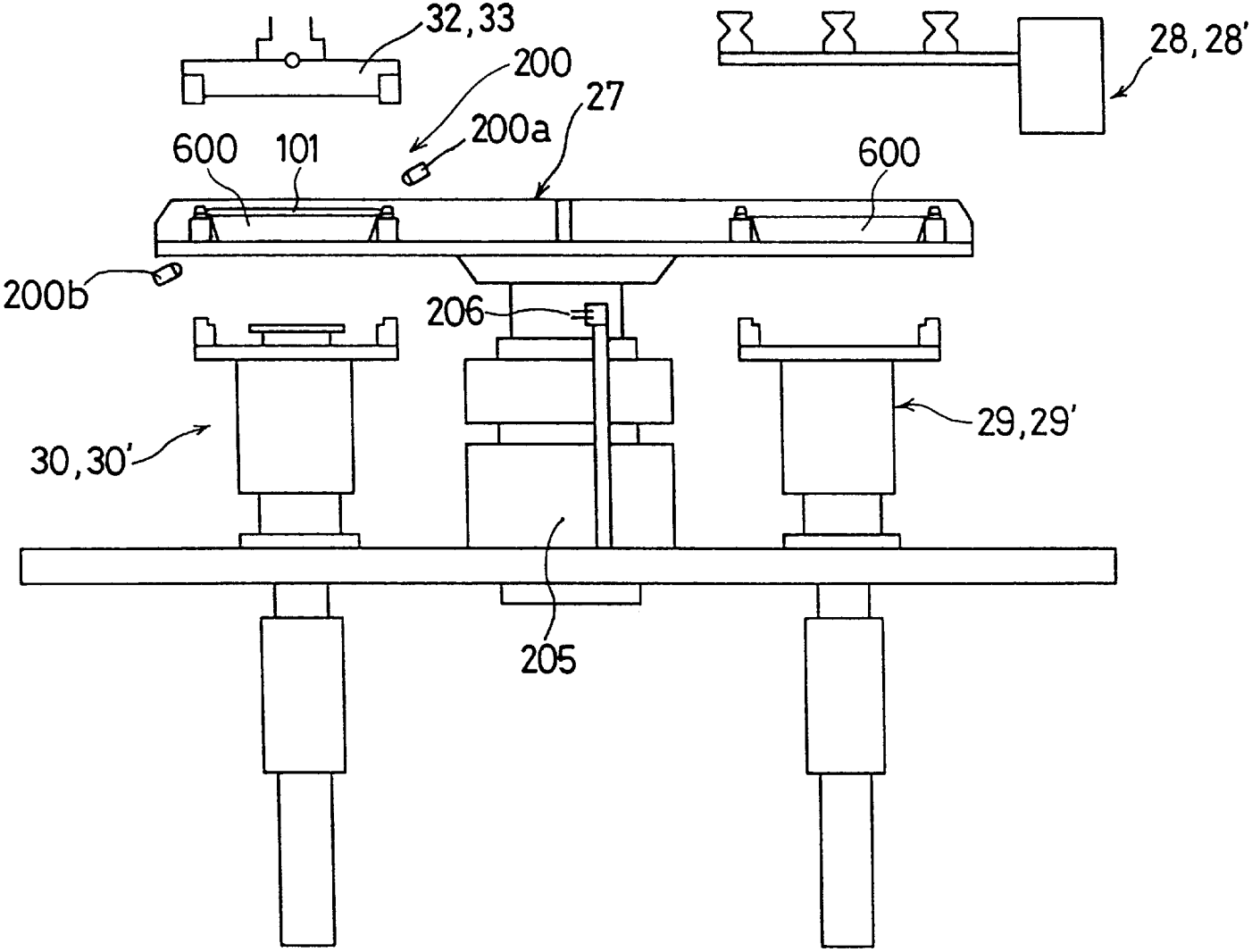

FIG. 14 is a schematic elevational view showing the rotary transporter and the components associated with the rotary transporter.

DETAILED DESCRIPTION OF THE PREFERRED EMBODIMENTS

A polishing apparatus according to an embodiment of the present invention will be described below with reference to FIGS. 1 through 14.

Figure 1:
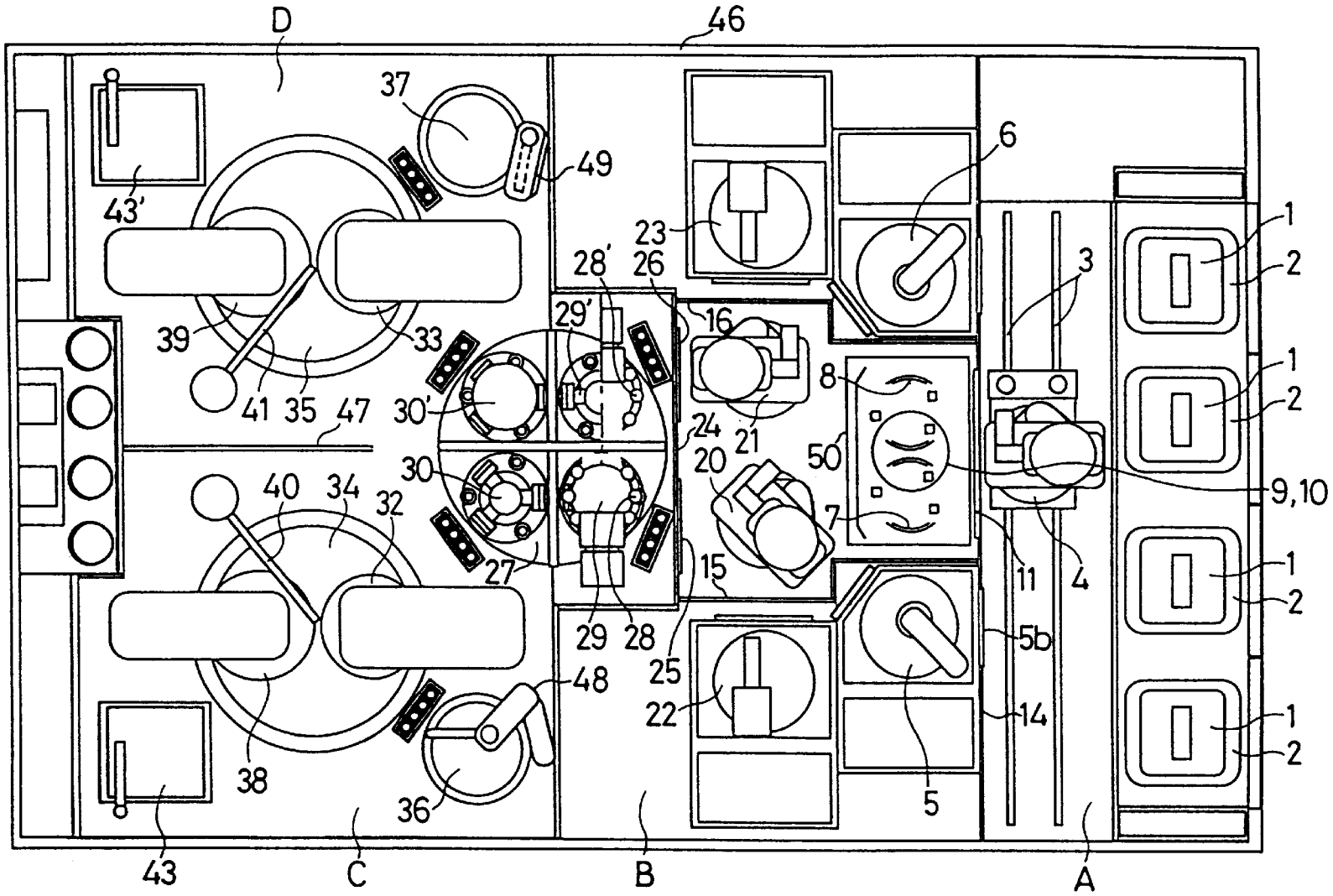
FIG. 1 is a plan view showing a layout of various components of a polishing apparatus according to an embodiment of the present invention.

FIG. 1 shows a layout of various components of a polishing apparatus according to the present invention.

As shown in FIG. 1, a polishing apparatus according to the present invention comprises four load-unload stages 2 each for placing a wafer cassette 1 which accommodates a plurality of semiconductor wafers. The load-unload stage 2 may have a mechanism for raising and lowering the wafer cassette 1. A transfer robot 4 having two hands is provided on rails 3 so that the transfer robot 4 can move along the rails 3 and access the respective wafer cassettes 1 on the respective load-unload stages 2.

Two cleaning apparatuses 5 and 6 are disposed at the opposite side of the wafer cassettes 1 with respect to the rails 3 of the transfer robot 4. The cleaning apparatuses 5 and 6 are disposed at positions that can be accessed by the hands of the transfer robot 4. Between the two cleaning apparatuses 5 and 6 and at a position that can be accessed by the transfer robot 4, there is provided a wafer station 50 having four wafer supports 7, 8, 9 and 10.

An area B in which the cleaning apparatuses 5 and 6 and the wafer station 50 having the wafer supports 7, 8, 9 and 10 are disposed and an area A in which the wafer cassettes 1 and the transfer robot 4 are disposed are partitioned by a partition wall 14 so that the cleanliness of the area B and the area A can be separated. The partition wall 14 has an opening for allowing semiconductor wafers to pass therethrough, and a shutter 11 is provided at the opening of the partition wall 14. A transfer robot 20 is disposed at a position where the transfer robot 20 can access the cleaning apparatus 5 and the three wafer supports 7, 9 and 10, and a transfer robot 21 is disposed at a position where the transfer robot 21 can access the cleaning apparatus 6 and the three wafer supports 8, 9 and 10.

A cleaning apparatus 22 is disposed at a position adjacent to the cleaning apparatus 5 and accessible by the hands of the transfer robot 20, and another cleaning apparatus 23 is disposed at a position adjacent to the cleaning apparatus 6 and accessible by the hands of the transfer robot 21.

All the cleaning apparatuses 5, 6, 22 and 23, the wafer supports 7, 8, 9 and 10 of the wafer station 50, and the transfer robots 20 and 21 are placed in the area B. The pressure in the area B is adjusted so as to be lower than the pressure in the area A. Each of the cleaning apparatuses 22 and 23 is capable of cleaning both surfaces of a semiconductor wafer.

The polishing apparatus has a housing 46 f or enclosing various components therein. The housing 46 constitutes an enclosing structure. The interior of the housing 46 is partitioned into a plurality of compartments or chambers (including the areas A and B) by partitions 14, 15, 16, 24 and 47.

A polishing chamber separated from the area B by the partition wall 24 is formed, and is further divided into two areas C and D by the partition wall 47. In each of the two areas C and D, there are provided two turntables, and a top ring for holding a semiconductor wafer and pressing the semiconductor wafer against the turntables. [That is, the turntables 34 and 36 are provided in the area C, and the turntables 35 and 37 are provided in the area D. Further, the top ring 32 is provided in the area C and the top ring 33 is provided in the area D.] An abrasive liquid nozzle 40 for supplying an abrasive liquid to the turntable 34 in the area C and a dresser 38 for dressing the turntable 34 are disposed in the area C. An abrasive liquid nozzle 41 for supplying an abrasive liquid to the turntable 35 in the area D and a dresser 39 for dressing the turntable 35 are disposed in the area D. A dresser 48 for dressing the turntable 36 in the area C is disposed in the area C, and a dresser 49 for dressing the turntable 37 in the area D is disposed in the area D.

Figure 2:
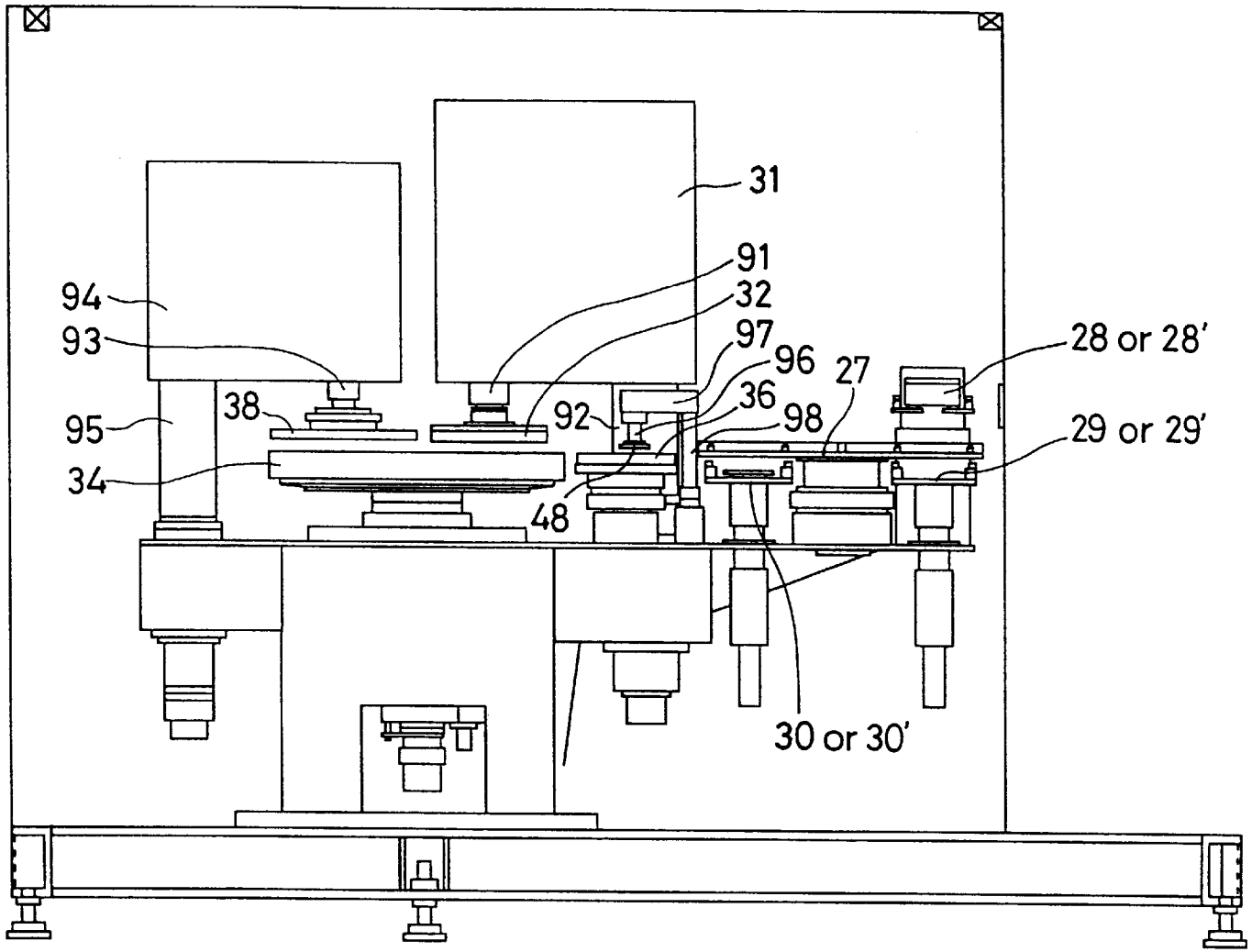
FIG. 2 is an elevational view showing the relationship between the top ring and the turntables.

FIG. 2 shows the relationship between the top ring 32 and the turntables 34 and 36. The relationship between the top ring 33 and the turntables 35 and 37 is the same as that of the top ring 32 and the turntables 34 and 36. As shown in FIG. 2, the top ring 32 is supported from a top ring head 31 by a top ring drive shaft 91 which is rotatable. The top ring head 31 is supported by a support shaft 92 which can be angularly positioned, and the top ring 32 can access the turntables 34 and 36. The dresser 38 is supported from a dresser head 94 by a dresser drive shaft 93 which is rotatable. The dresser head 94 is supported by an angularly positionable support shaft 95 for moving the dresser 38 between a standby position and a dressing position over the turntable 34. The dresser 48 is similarly supported from a dresser head 97 by a dresser drive shaft 96 which is rotatable. The dresser head 97 is supported by an angularly positionable support shaft 98 for moving the dresser 48 between a standby position and a dressing position over the turntable 36.

As shown in FIG. 1, in the area C separated from the area B by the partition wall 24 and at a position that can be accessed by the hands of the transfer robot 20, there is provided a reversing device 28 for reversing a semiconductor wafer, and at a position that can be accessed by the hands of the transfer robot 21, there is provided a reversing device 28' for reversing a semiconductor wafer. The partition wall 24 between the area B and the areas C, D has two openings each for allowing semiconductor wafers to pass therethrough, one of which is used for transferring the semiconductor wafer to or from the reversing device 28 and the other of which is used for transferring the semiconductor wafer to or from the reversing device 28'. Shutters 25 and 26 are provided at the respective openings of the partition wall 24.

The reversing devices 28 and 28' have a chuck mechanism for chucking a semiconductor wafer, a reversing mechanism for reversing a semiconductor wafer, and a semiconductor wafer detecting sensor for detecting whether the chuck mechanism chucks a semiconductor wafer or not, respectively. The transfer robot 20 transfers a semiconductor wafer to the reversing device 28, and the transfer robot 21 transfers a semiconductor wafer to the reversing device 28'.

A rotary transporter 27 is disposed below the reversing devices 28 and 28' and the top rings 32 and 33, for transferring semiconductor wafers between the cleaning chamber (area B) and the polishing chamber (areas C and D). The rotary transporter 27 has four stages for placing a semiconductor wafer at equal angular intervals, and can hold a plurality of semiconductor wafers and a plurality of support tables thereon at the same time.

Figure 3:
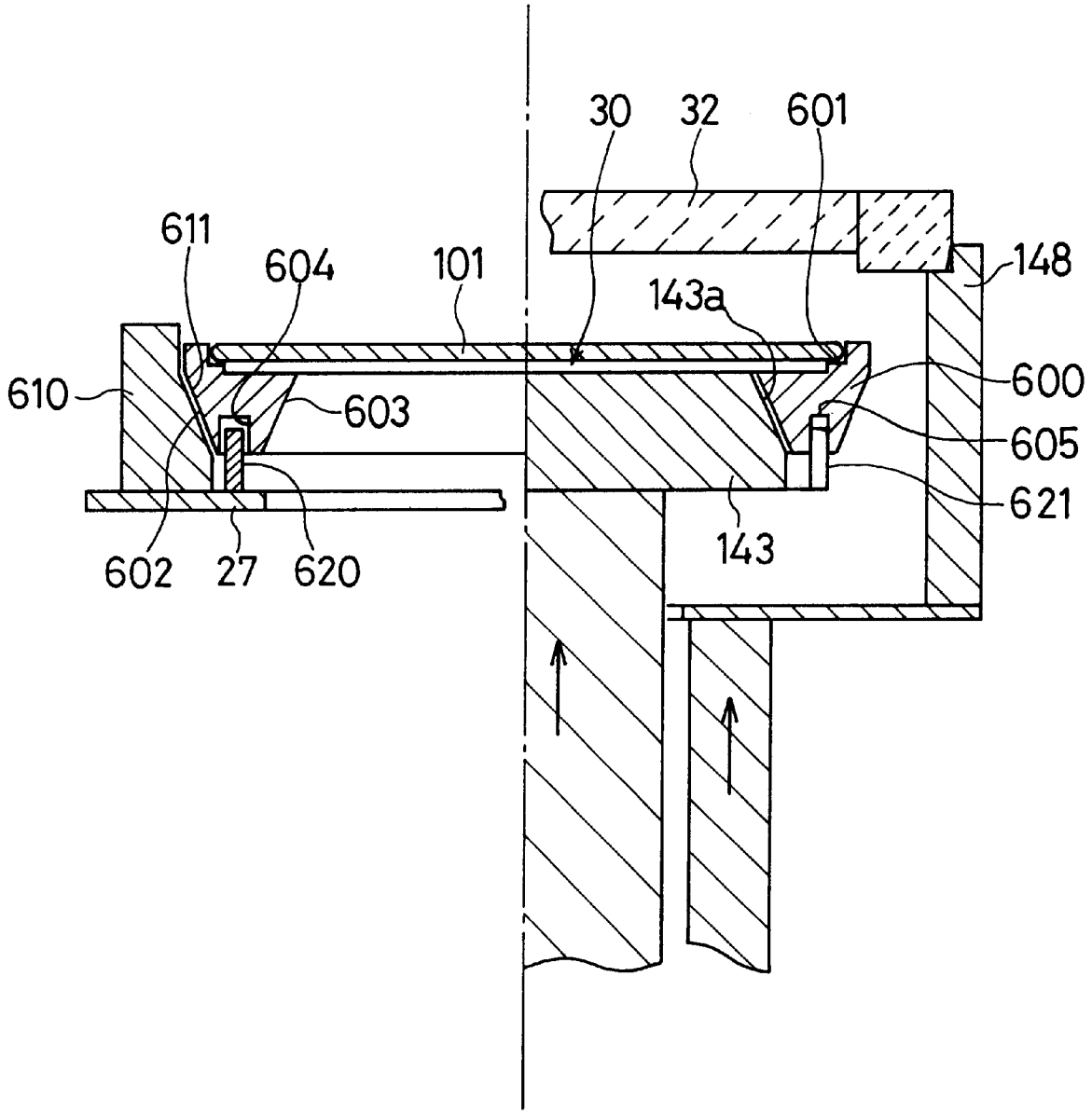
FIG. 3 is a vertical cross-sectional view showing a structure of a wafer support table, the left half of the drawing shows the wafer support table held by a rotary transporter, and the right half of the drawing shows the wafer support table held by a pusher.

FIG. 3 shows a structure of a ring-shaped wafer support table 600. In FIG. 3, the left half of the drawing shows the wafer support table held by a rotary transporter, and the right half of the drawing shows the wafer support table held by a pusher. As shown in FIG. 3, the wafer support table 600 has a wafer support surface 601 at an upper surface thereof for placing a semiconductor wafer 101 and holding the semiconductor wafer 101, and a tapered surface 602 at an outer surface thereof for automatically centering the wafer support table 600 with respect to guide blocks 610 provided on each of the stages. Further, the wafer support table 600 has another tapered surface 603 at an inner surface thereof for automatically centering the wafer support table 600 with respect to the lifter or the pusher (in FIG. 3, the pusher 30 engaged with the tapered surface 603 is shown). The lower surface of the wafer support table 600 has holes 604 into which pins 620 provided on the rotary transporter 27 are fitted, and holes 605 into which pins 621 provided on the lifter or the pusher are fitted (in FIG. 3, the pusher 30 having the pins 621 fitted into the holes 605 is shown). The holes 604, 605 and the pins 620, 621 serve to prevent the wafer support table 600 from being rotated with respect to the rotary transporter, and the pusher (or the lifter), respectively.

The semiconductor wafer which has been transported to the reversing device 28 or 28' is transferred to the wafer support table 600 placed on the lifter 29 or 29' by actuating the lifter 29 or 29' disposed below the rotary transporter 27 when the center of the stage of the rotary transporter 27 is aligned with the center of the semiconductor wafer held by the reversing device 28 or 28'. The semiconductor wafer which has been transported to the wafer support table 600 on the lifter 29 or 29' is transferred together with the wafer support table 600 to the rotary transporter 27 by lowering the lifter 29 or 29'. The semiconductor wafer and the wafer support table 600 placed on the stage of the rotary transporter 27 are transported to a position below the top ring 32 or 33 by rotating the rotary transporter 27 by an angle of 90°. At this time, the top ring 32 or 33 is positioned above the rotary transporter 27 beforehand by a swing motion thereof.

The semiconductor wafer is transferred together with the wafer support table 600 from the rotary transporter 27 to the pusher 30 or 30' and finally only the semiconductor wafer is transferred to the top ring 32 or 33 (in FIG. 3, the top ring 32 is shown) by actuating the pusher 30 or 30' disposed below the rotary transporter 27 when the center of the top ring 32 or 33 is aligned with the center of the semiconductor wafer placed on the wafer support table 600 on the rotary transporter 27.

The semiconductor wafer transferred to the top ring 32 or 33 is held under vacuum by a vacuum attraction mechanism of the top ring 32 or 33, and transported to the turntable 34 or 35. Thereafter, the semiconductor wafer is polished by a polishing surface comprising a polishing cloth or a grinding stone (or a fixed abrasive plate) attached on the turntable 34 or 35. The second turntables 36 and 37 are disposed at positions that can be accessed by the top rings 32 and 33, respectively. With this arrangement, a primary polishing of the semiconductor wafer can be conducted by the first turntable 34, and then a secondary polishing of the semiconductor wafer can be conducted by the second turntable 36. Alternatively, the primary polishing of the semiconductor wafer can be conducted by the second turntable 36 or 37, and then the secondary polishing of the semiconductor wafer can be conducted by the first turntable 34 or 35. In this case, since the second turntable 36 or 37 has a smaller-diameter polishing surface than the first turntable 34 or 35, a grinding stone (or a fixed abrasive plate) which is more expensive than a polishing cloth is attached to the second turntable 36 or 37 to thereby conduct a primary polishing of the semiconductor wafer. On the other hand, the polishing cloth having a shorter life but being cheaper than the grinding stone (or the fixed abrasive plate) is attached to the first turntable 34 or 35 to thereby conduct a finish polishing of the semiconductor wafer. This arrangement or utilization may reduce the running cost of the polishing apparatus.

The semiconductor wafer which has been polished is returned to the reversing device 28 or 28' in the reverse route to the above. The semiconductor wafer returned to the reversing device 28 or 28' is rinsed by pure water or chemicals supplied from rinsing nozzles. Further, the semiconductor wafer holding surface of the top ring 32 or 33 from which the semiconductor wafer has been removed is also cleaned by pure water or chemicals supplied from cleaning nozzles.

On the right side of FIG. 2, the relationship of the rotary transporter 27, the reversing device 28 or 28', the lifter 29 or 29', and the pusher 30 or 30' is shown. As shown in FIG. 2, the reversing device 28 or 28' is disposed above the rotary transporter 27, and the pusher 30 or 30' is disposed below the rotary transporter 27.

WAFER SUPPORT TABLE AND ROTARY TRANSPORTER

In the following description, the top ring 32, the reversing device 28, the lifter 29 and the pusher 30 are used for explanation of transfer operation.

Figure 4:
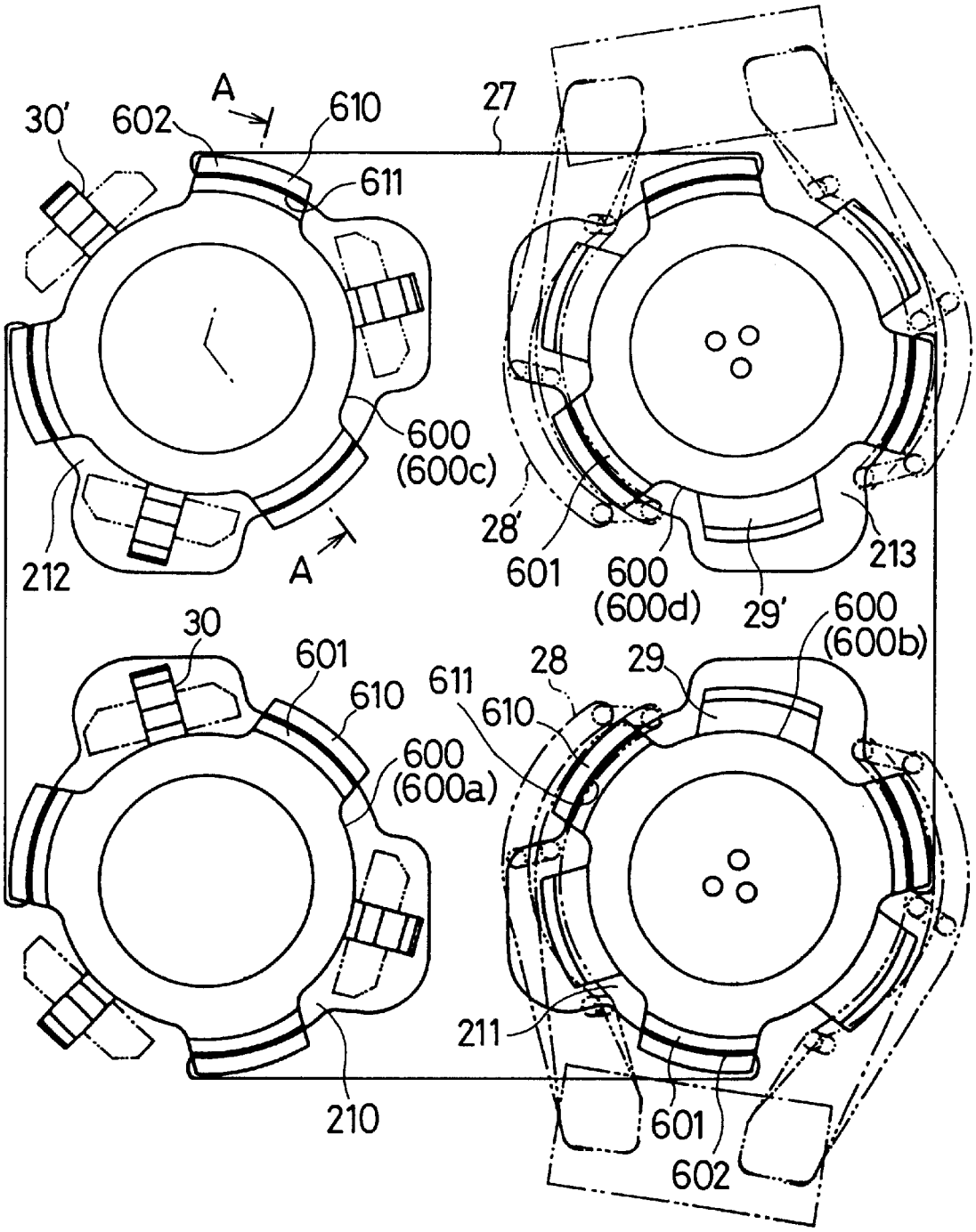
FIG. 4 is a plan view showing the rotary transporter and the wafer support tables.
Figure 5:
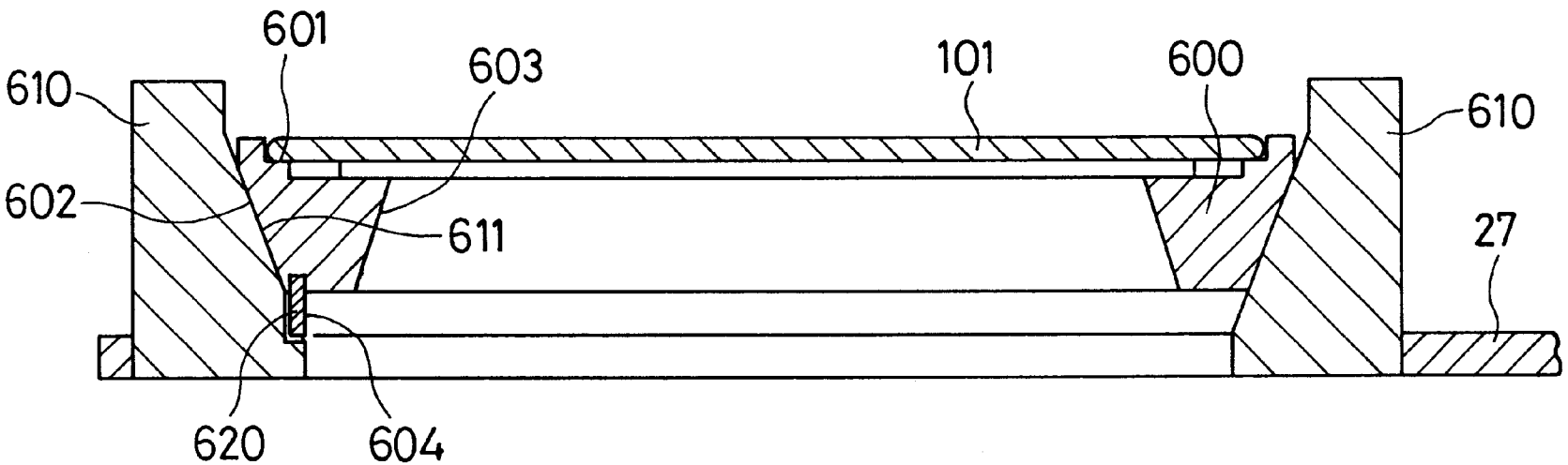
FIG. 5 is a cross-sectional view taken along line A—A of FIG. 4.
Figures 6A, 6B, 6C:
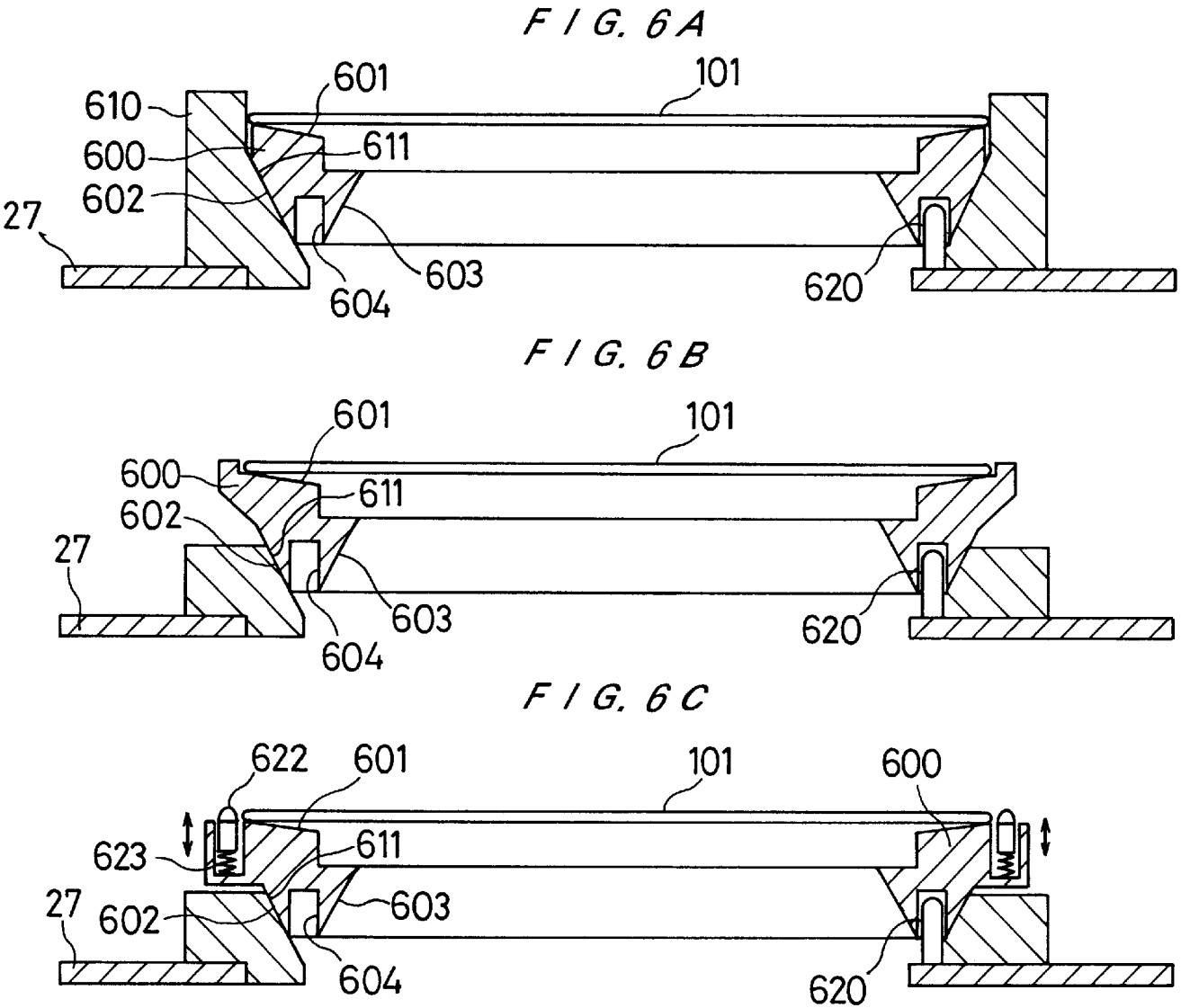
FIGS. 6A through 6C are vertical cross-sectional views showing other wafer support tables.

FIGS. 4 and 5 show the relationship between the rotary transporter 27 and the wafer support tables 600. FIG. 4 is a plan view showing the rotary transporter 27 and the wafer support tables, whereas FIG. 5 is a cross-sectional view taken along line A—A of FIG. 4. As shown in FIGS. 4 and 5, the wafer support table 600 has a wafer support surface 601 at an upper surface thereof for placing a semiconductor wafer 101 and holding the semiconductor wafer 101, and a tapered surface 602 at an outer surface thereof for automatically centering the wafer support table 600 with respect to guide blocks 610 by tapered surfaces 611 of the guide blocks 610. Further, the wafer support table 600 has another tapered surface 603 at an inner surface thereof for automatically centering the wafer support table 600 with respect to the lifter 29 or the pusher 30. The wafer support table 600 shown in FIGS. 4 and 5 has a projection extending upwardly from the outer periphery of the wafer support surface 601 for preventing the semiconductor wafer 101 from being dislodged therefrom. In place of the projection, as shown in FIG. 6C, a plurality of pins 622 which are projectable upwardly from the wafer support surface 601 by springs 623 which may be provided around the wafer support surface 601. In this case, when the top ring 32 holds the semiconductor wafer 1010 under vacuum, the pins 622 are retracted from the wafer support surface 601 against urging force of the springs 623 to thus form no obstacle.

In this embodiment, the wafer support surface 601 is composed of a flat surface. However, as shown in FIGS. 6A and 6B, the wafer support surface 601 may be composed of a tapered surface which is downwardly inclined toward a radially inner direction. The tapered wafer surface 601 is desirable for reducing a contact area between the semiconductor wafer 101 and the wafer support surface 601 and discharging an abrasive liquid transferred from the semiconductor wafer 101 and attached to the wafer support surface 601 smoothly there from. The wafer support surface 601 is not required to be provided in a full circumferential surface of the wafer support table, and may be provided at three locations, or preferably six locations in a circumferential direction.

Further, the wafer support table 600 has the holes 604 into which the pins 620 provided on the rotary transporter 27 are fitted. Conversely, the wafer support table may have pins and the rotary transporter may have holes into which the pins on the wafer support table are fitted. Further, the wafer support table and the rotary transporter may have notches or teeth which engage with one another.

Further, in the embodiment shown in FIGS. 4 and 5, the tapered surface 603 is provided independently of the tapered surface 602. However, the tapered surface 602 may be used for being fitted with the rotary transporter 27, and the pusher 30 or the lifter 29. In this case, it is necessary that the surface to be fitted with the rotary transporter and the surface to be fitted with the pusher or the lifter are different from each other in a circumferential direction.

ROTARY TRANSPORTER

As shown in FIGS. 4 and 5, the rotary transporter 27 for placing the wafer support table 600 and transporting the wafer support table 600 has four wafer support table stages at angularly equal intervals of 90°, and each of the four wafer support table stages has guide blocks 610 at three locations in a circumferential direction for supporting the wafer support table 600 by being fitted with the tapered surface 602 of the wafer support table 600. A tapered surface 611 having a taper angle of 15° to 25° with respect to the perpendicular is formed at an inner surface of the guide block 610 to allow the wafer support table 600 to be centered when the wafer support table 600 is transferred.

FIG. 14 is a schematic elevational view showing the rotary transporter and the components associated with the rotary transporter. As shown in FIG. 14, the wafer detecting sensors 200 are provided at positions spaced from the rotary transporter 27. The wafer detecting sensor 200 is a photosensor comprising a light emitting element 200*a* and a light receiving element 200*b*, and is not moved with the stages of the rotary transporter 27.

The conditions of the semiconductor wafers 101 which are placed on the stages are determined in the respective stages of the rotary transporter 27. To be more specific, as shown in FIG. 4, the rotary transporter 27 comprises two load stages for placing the wafer support table 600 (600*a*, 600*c*) for loading the semiconductor wafer to be polished and two unload stages for placing the wafer support table 600 (600*b*, 600*d*) for unloading the semiconductor wafer which has been polished. The conditions of the wafer support table 600 placed on the respective stages are always fixed, and the rotary transporter 27 has a stage 210 for placing the wafer support table 600 (600*a*) for holding the semiconductor wafer to be polished on the turntable 34, a stage 211 for placing the wafer support table 600 (600*b*) for holding the semiconductor wafer which has been polished on the turntable 34, a stage 212 for placing the wafer support table 600 (600*c*) for holding the semiconductor wafer to be polished on the turntable 35, and a stage 213 for placing the wafer support table 600 (600*d*) for holding the semiconductor wafer which has been polished on the turntable 35.

Rinsing nozzles for supplying a cleaning liquid to the semiconductor wafers and the wafer support tables 600 are provided above or below the rotary transporter 27 and in the positions spaced from the rotary transporter 27. The rinsing nozzles are stationary and are not rotated with the stages. Pure water or ionic water is mainly used as a cleaning liquid. As shown in FIG. 14, the rotary transporter 27 is coupled to a servomotor 205, and the semiconductor wafers and the wafer support tables on the rotary transporter 27 are transported by driving the servomotor 205. A home position sensor 206 is provided on the lower portion of the rotary transporter 27, and positioning of the wafer transfer position is controlled by the home position sensor 206 and the servomotor 205. The transfer positions which can be positioned are three positions at angular intervals of 90° with respect to the home position as a center.

LIFTER

Figure 7:
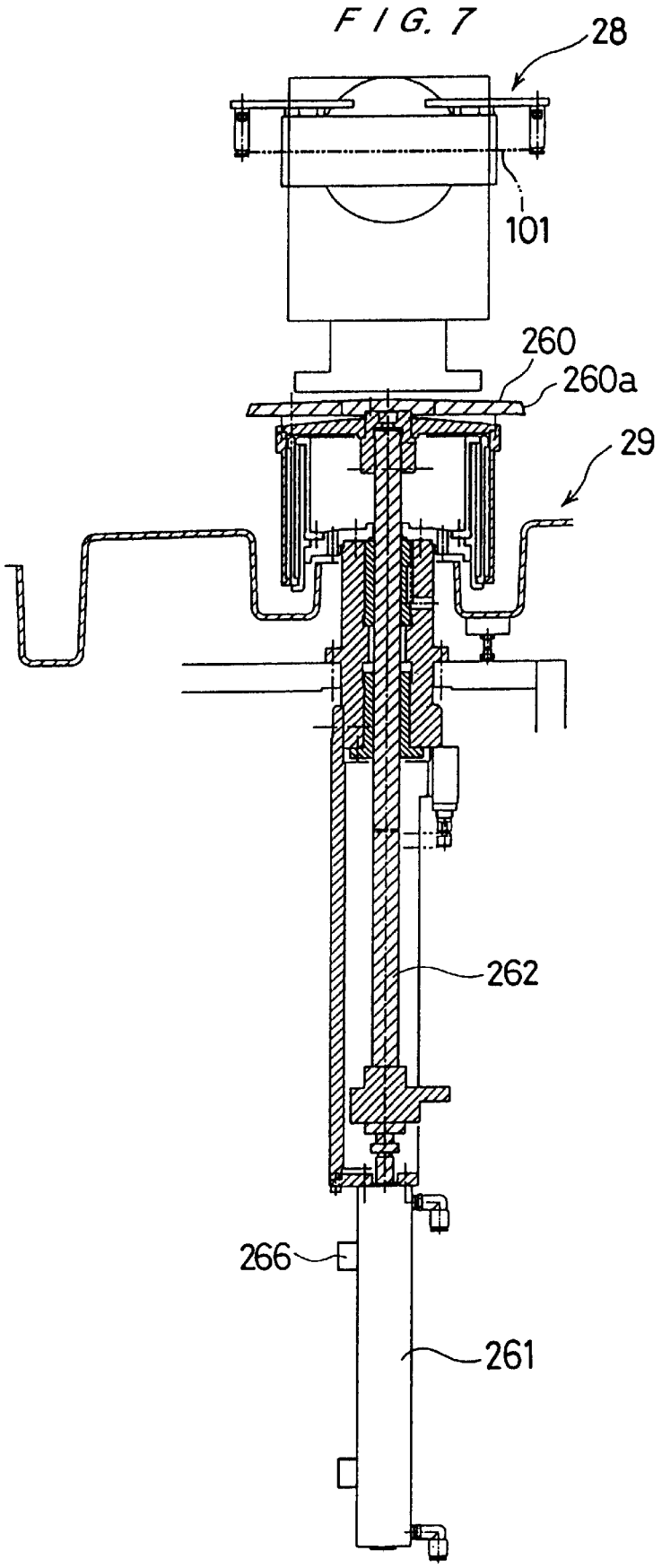
FIG. 7 is a vertical cross-sectional view of the lifter.
Figure 8:
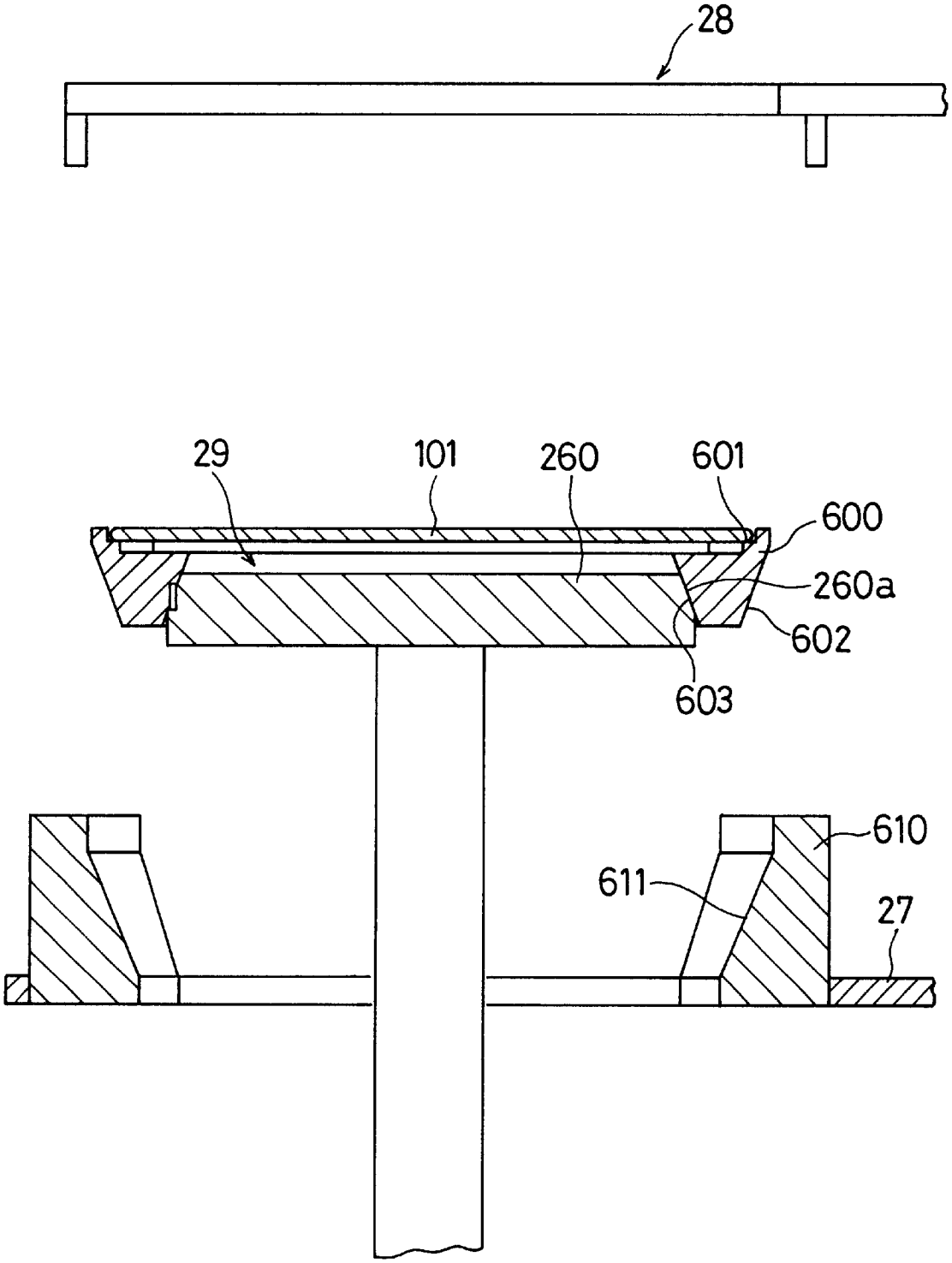
FIG. 8 is a vertical cross-sectional view showing the relationship between the lifter and the wafer support table.

FIG. 7 is a vertical cross-sectional view of the lifter. FIG. 8 is a vertical cross-sectional view showing the relationship between the lifter and the wafer support table. The lifter 29 comprises a stage 260 for placing the wafer support table 600 thereon and an air cylinder 261 for lifting and lowering the stage 260. The air cylinder 261 and the stage 260 are coupled by a shaft 262 which is vertically movable.

As shown in FIG. 8, the stage 260 has a tapered surface 260*a*, at an outer circumferential surface thereof, which is fitted in the tapered surface 603 of the wafer support table 600. When the stage 260 of the lifter 29 is raised to a position above the rotary transporter 27, the wafer support table 600 is fitted over the stage 260 to allow the wafer support table 600 to be centered, and is then raised.

PUSHER

Figure 9:
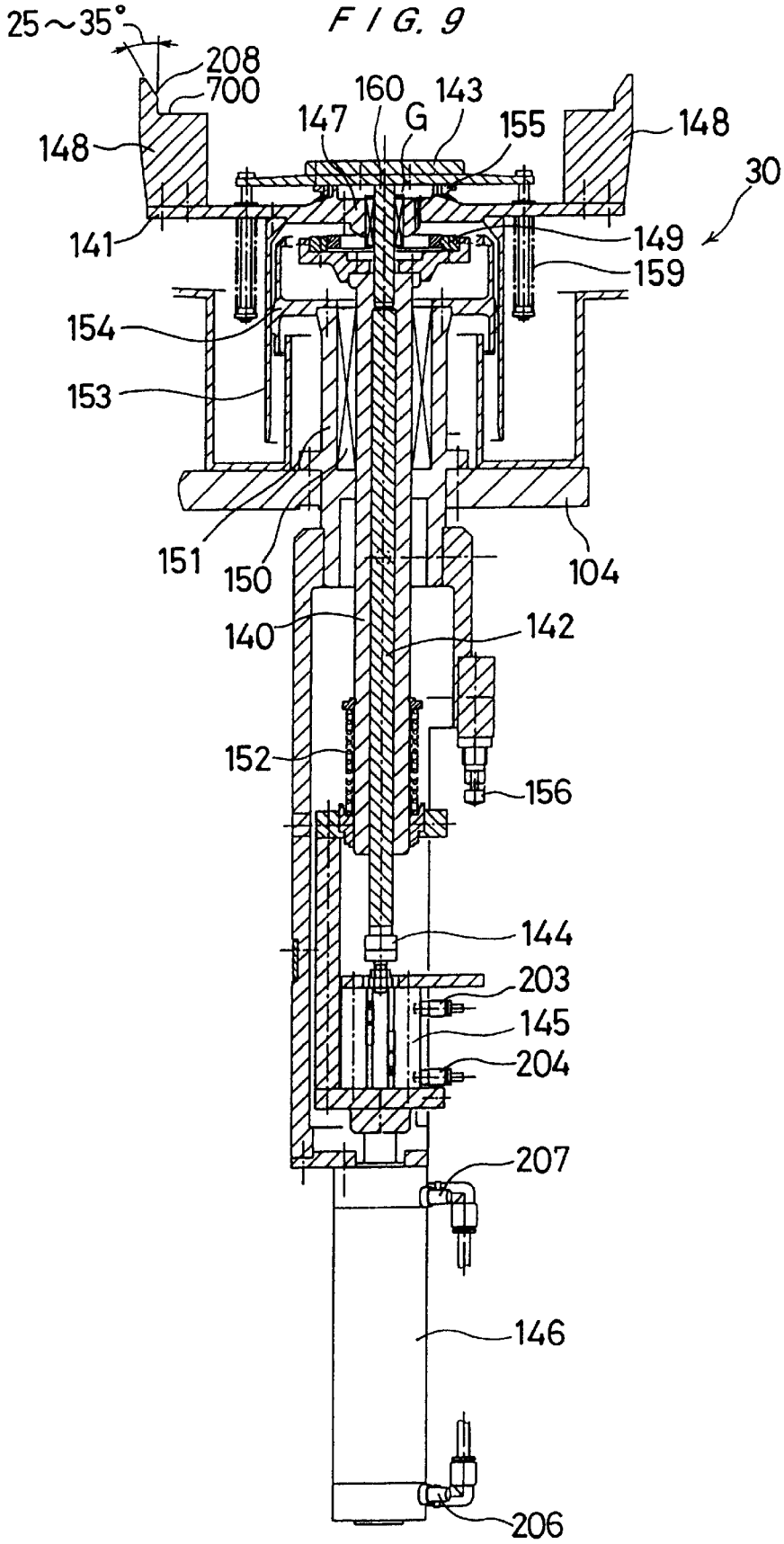
FIG. 9 is a vertical cross-sectional view of the pusher.
Figure 10:
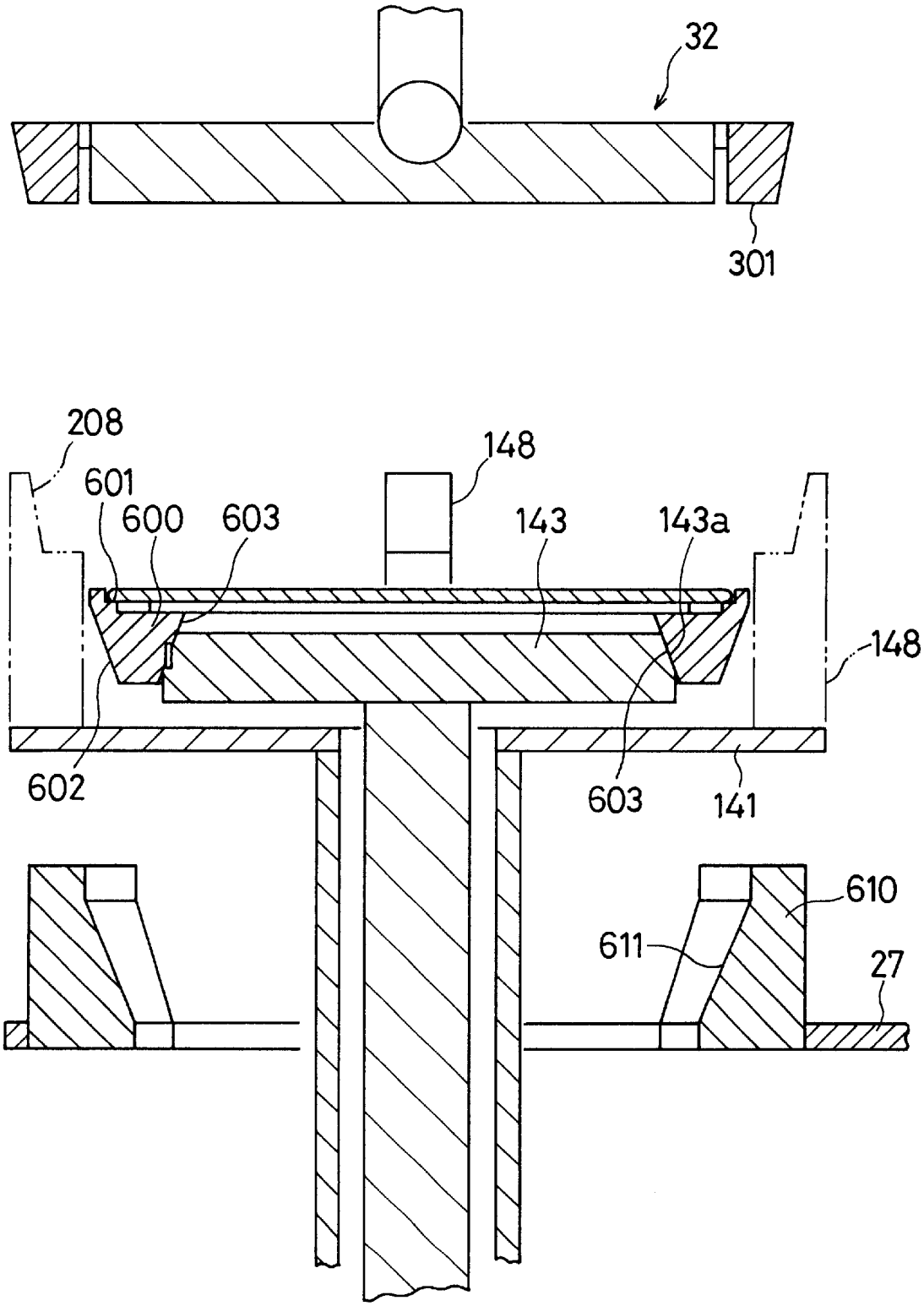
FIG. 10 is a vertical cross-sectional view showing the relationship between the pusher and the wafer support table.

FIGS. 9 and 10 show a pusher, and FIG. 9 is a vertical cross-sectional view of the pusher and FIG. 10 is a vertical cross-sectional view showing the relationship between the pusher and the wafer support table.

As shown in FIG. 9, a guide stage 141 for holding the top ring guide 148 is provided above a hollow shaft 140, and a spline shaft 142 is provided in the hollow shaft 140. A push stage 143 is provided above the spline shaft 142. An air cylinder 145 is coupled to the spline shaft 142 through a flexible joint 144. Two air cylinders are disposed vertically in series. The lower air cylinder 146 serves to lift and lower the guide stage 141 and the push stage 143, and lifts and lowers the hollow shaft 140 together with the air cylinder 145. The air cylinder 145 serves to lift and lower the push stage 143.

A linear way 149 movable in directions of an X-axis and a Y-axis is provided to allow the top ring guides 148 to have an alignment mechanism. The guide stage 141 is fixed to the linear way 149, and the linear way 149 is fixed to the hollow shaft 140. The hollow shaft 140 is held by a bearing case 151 through a slide bush 150. The stroke of the air cylinder 146 is transmitted to the hollow shaft 140 through a compression spring 152.

The push stage 143 is located above the guide stage 141, and a push rod 160 extending downwardly from the center of the push stage 143 passes through a slide bush 147 located at the center of the guide stage 141 to allow the push rod 160 to be centered. The push rod 160 contacts the upper end of the spline shaft 142. The push stage 143 is vertically moved by the air cylinder 145 through the spline shaft 142, so that the semiconductor wafer 101 is loaded on the top ring 32. Compression springs 159 are provided at the peripheral portion of the push stage 143.

Three top ring guides 148 are provided at the outer circumferential portion of the guide stage 141. Each of the top ring guides 148 has an upper surface 700 serving as an access portion to the lower surface of the guide ring 301 of the top ring 32. A tapered surface 208 having an angle of 25° to 35° with respect to the perpendicular is formed at the upper end portion of the top ring guide 148 for guiding the guide ring 301 of the top ring 32 toward the upper surface 700.

The push stage 143 has an upper tapered surface 143*a*. As shown in FIG. 10, the tapered surface 143*a* is fitted in the tapered surface 603 of the wafer support table 600 to allow the wafer support table 600 to be centered with respect to the push stage 143. When the push stage 143 is raised, the wafer support table 600 is separated from the rotary transporter 27 and moved together with the semiconductor wafer toward the top ring 32.

A guide sleeve 153 is fixed to the guide stage 141 to prevent water from entering the central part of the guide stage 141 and to guide the guide stage 141 so that the guide stage 141 is returned to its original position. A center sleeve 154 located inside of the guide sleeve 153 is fixed to the bearing case 151 for centering the guide stage 141. The pusher is fixed to a motor housing 104 in the polishing section through the bearing case 151.

A V-ring 155 is used to prevent water from entering between the push stage 143 and the guide stage 141, and has a lip held in contact with the guide stage 141 to prevent water from passing therethrough. When the guide stage 141 is elevated, the volume of a portion G increases, thus lowering the pressure to thereby draw water. In order to prevent water from being drawn, the V-ring 155 has a hole defined in an inner side thereof to prevent the pressure from being lowered.

A shock absorber 156 is provided for positioning of the top ring guides 148 in a vertical direction and for shock-absorbing when the top ring guides 148 contact the top ring 32. In each of the air cylinders, upper and lower limit sensors are provided for detecting the position of the pusher in a vertical direction. That is, sensors 203 and 204 are provided on the air cylinder 145, and sensors 207 and 206 are provided on the air cylinder 146. A cleaning nozzle or nozzles for cleaning the pusher are provided to prevent the slurry attached to the pusher from contaminating the semiconductor wafer. A sensor for confirming the presence or absence of the semiconductor wafer on the pusher may be provided. The control of the air cylinders 145 and 146 are performed by double solenoid valves, respectively. The pushers 30 and 30' are dedicatedly provided for the top rings 32 and 33, respectively.

Next, the operation of the rotary transporter 27, the lifter 29 and the pusher 30 having the above structure will be described.

TRANSFERRING A SEMICONDUCTOR WAFER

FIGS. 11A through 11F show processes for transferring a semiconductor wafer. In the following description, the wafer support table for loading the semiconductor wafer to be polished is referred to as the loading wafer support table, and the wafer support table for unloading the semiconductor wafer which has been polished is referred to as the unloading wafer support table.

Figures 11A, 11B, 11C, 11D, 11E, 11F:
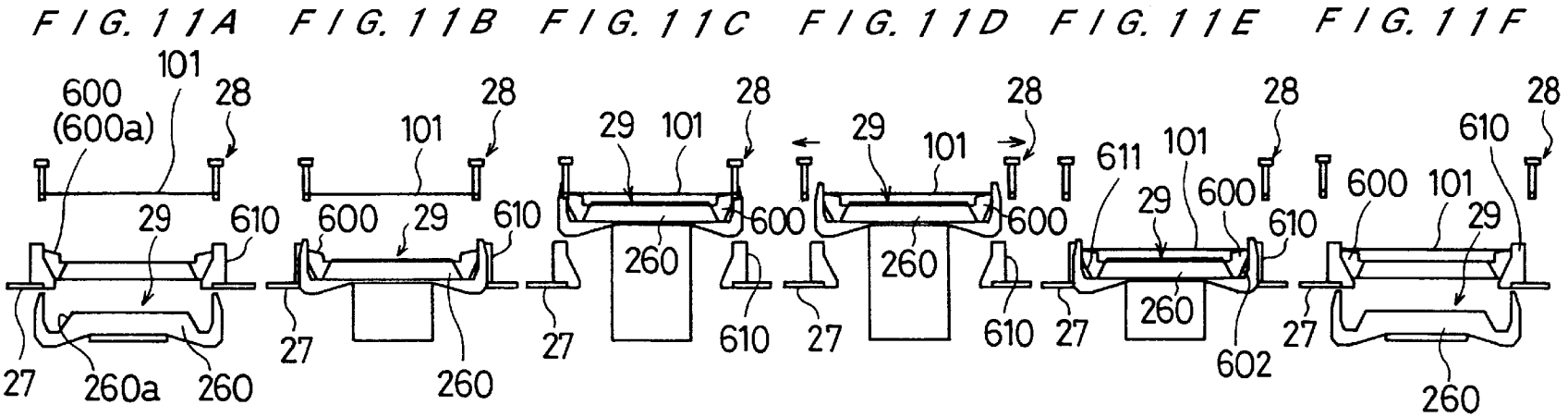
FIGS. 11A through 11F are schematic views showing the processes in which the semiconductor wafer, to be polished, held by the reversing device is transferred to the wafer support table, and then the wafer support table is transferred to the rotary transporter.

In the home position (HP), the rotary transporter 27 is rotated counterclockwise by an angle of 90°, and the stage 210 is located above the lifter 29 (FIG. 11A).

The lifter 29 constitutes a wafer transfer mechanism for transferring the semiconductor wafer between the reversing device 28 and the rotary transporter 27. The semiconductor wafer 101 to be polished is transferred from the transfer robot 20 to the reversing device 28. Thereafter, the semiconductor wafer 101 is reversed by the reversing device 28 to cause a pattern surface (the surface on which semiconductor device is formed) of the semiconductor wafer to face downward.

The lifter 29 is raised, and the stage 260 of the lifter 29 is engaged with the loading wafer support table 600 (600*a*) on the rotary transporter 27 by the tapered surface 260*a* (FIG. 11B).

Next, the lifter 29 is raised to a position where the loading wafer support table 600 receives the semiconductor wafer 101 from the reversing device 28 while the lifter 29 supports the loading wafer support table 600 thereon, and the lifter 29 is stopped thereat (FIG. 11C).

When the sensor 266 provided on the air cylinder 261 detects the stop of the lifter 29 at a position where the stage 260 is located immediately below the semiconductor wafer 101, the reversing device 28 releases the semiconductor wafer by opening the arms and the semiconductor wafer 101 is placed on the loading wafer support table 600 on the stage 260 of the lifter 29 (FIG. 11D). Thereafter, the lifter 29 is lowered while the lifter 29 holds the loading wafer support table 600 having the semiconductor wafer 101 thereon (FIG. 11E).

The loading wafer support table 600 holding the semiconductor wafer 101 and placed on the lifter 29 is centered by the tapered surfaces 611 of the guide blocks 610 on the stage 210 of the rotary transporter 27, and transferred from the lifter 29 to the rotary transporter 27 and placed on the guide blocks 610 (FIG. 11E). After the loading wafer support table 600 is placed on the rotary transporter 27, the lifter 29 continues to be operated to cause the stage 260 to be lowered until the stage 260 does not interfere with the rotary transporter 27 even when the rotary transporter 27 is rotated (FIG. 11F).

LOADING A SEMICONDUCTOR WAFER

FIGS. 12A through 12F show processes for loading a semiconductor wafer.

Figures 12A, 12B, 12C, 12D, 12E, 12F:
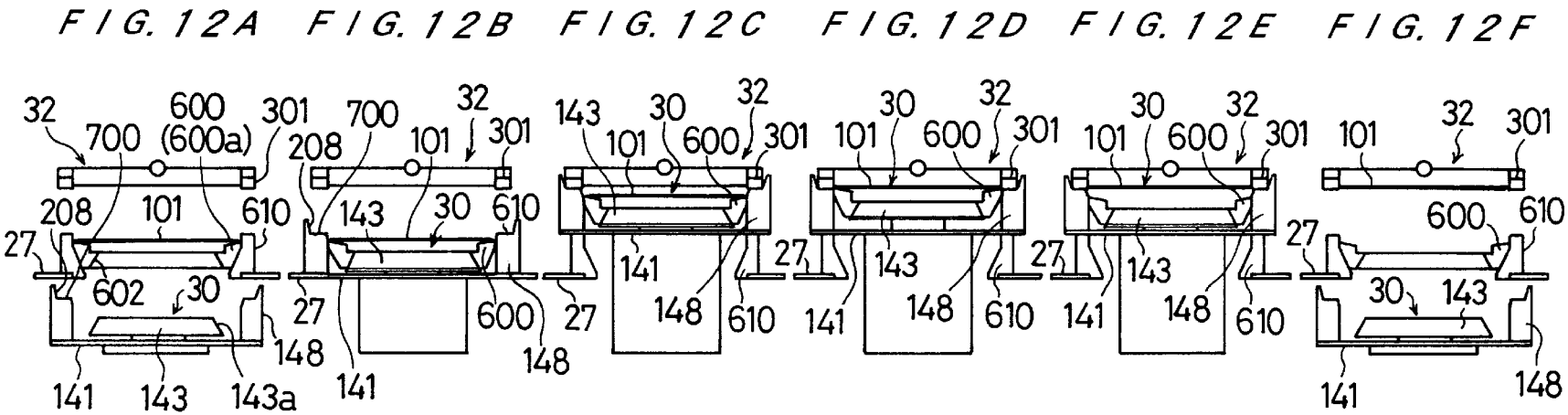
FIGS. 12A through 12F are schematic views showing the processes in which the semiconductor wafer, to be polished, held by the wafer support table is transferred to the pusher.

When lowering of the lifter 29 is completed, the rotary transporter 27 is rotated clockwise by an angle of 90° and the loading wafer support table 600 (600*a*) on the rotary transporter 27 is positioned above the pusher 30 (FIG. 12A). After positioning of the rotary transporter 27 is completed, the pusher 30 is raised together with the components associated with the guide stage 141 by the air cylinder 146. While the pusher 30 is raised, the guide stage 141 passes through the wafer holding position of the rotary transporter 27. At this time, the loading wafer support table 600 holding the semiconductor wafer 101 is centered by the tapered surfaces 143a of the push stage 143, and transferred from the rotary transporter 27 to the push stage 143 (FIG. 12B).

While the push stage 143 holds the loading wafer support table 600, the top ring guides 148 are raised without being stopped, and the guide ring 301 of the top ring 32 is guided by the tapered surfaces 208 of the top ring guides 148. The center of the top ring guides 148 is aligned with the center of the top ring 32 by the linear way 149 movable in X and Y directions, and the upper surface 700 of the top ring guides 148 contact the lower surface of the guide ring 301 and lifting of the guide stage 141 is completed (FIG. 12C).

When the upper surface 700 of the top ring guides 148 contact the lower surface of the guide ring 301, the guide stage 141 is fixed and is not raised anymore. However, the air cylinder 146 continues to be actuated until the stopper fixed to the rod of the air cylinder 146 contacts the shock absorber 156, and hence only the spline shaft 142 continues to be raised because the compression spring 152 is compressed, and the push stage 143 is further raised. After the semiconductor wafer 101 contacts the top ring 32, the lifting stroke of the air cylinder 146 is absorbed by the compression springs 159 to thereby protect the semiconductor wafer 101 against damage.

Next, the push stage 143 is further raised by the air cylinder 145 while the push stage 143 holds the wafer support table 600, and the semiconductor wafer 101 is held by the top ring 32 under vacuum by the vacuum attraction mechanism of the top ring 32 (FIG. 12D). Thereafter, the wafer support table 600 is lowered together with the push stage 143 by the air cylinder 145 which is actuated in the opposite direction to the above actuation (FIG. 12E).

The pusher 30 is lowered together with the components associated with the guide stage 141 by the air cylinder 146, and the wafer support table 600 is transferred to the rotary transporter 27 while the pusher 30 is lowered. The pusher 30 is further lowered, and then stopped at a predetermined position (FIG.12F).

UNLOADING A SEMICONDUCTOR WAFER

Figures 13A, 13B, 13C, 13D, 13E, 13F:
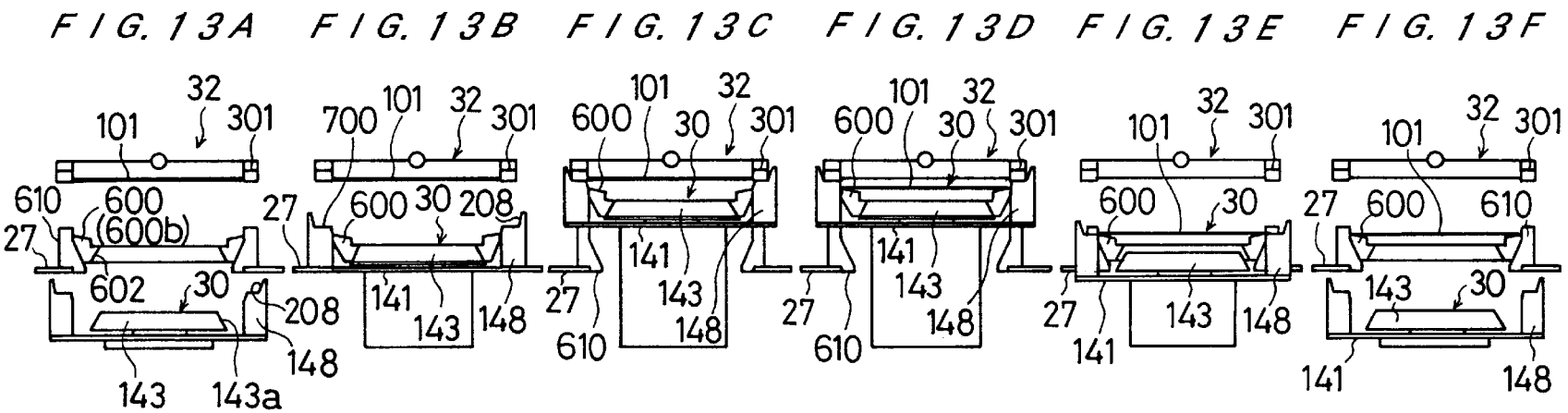
FIGS. 13A through 13F are schematic views showing the processes in which the polished semiconductor wafer held by the top ring is transferred to the wafer support table, and then the wafer support table is transferred to the rotary transporter.

The semiconductor wafer 101 which has been polished is transported by the top ring 32 to a wafer unload position located above the pusher 30. By the rotation of the rotary transporter 27, the unloading wafer support table 600 (600*b*) on the rotary transporter 27 is located above the pusher 30 (FIG. 13A). Then, the pusher 30 is raised together with the components associated with the guide stage 141 by the air cylinder 146. While the pusher 30 is raised, the guide stage 141 passes through the wafer holding position of the rotary transporter 27. At this time, the wafer support table 600 having no semiconductor wafer is centered by the tapered surface 143*a* of the push stage 143, and transferred from the rotary transporter 27 to the pusher 30 (FIG. 13B).

The guide ring 301 of the top ring 32 is guided by the tapered surfaces 208 of the top ring guides 148. The center of the top ring guides 148 is aligned with the center of the top ring 32 by the linear way 149, and the upper surface 700 of the top ring guides 148 contact the lower surface of the guide ring 301 and the lifting of the guide stage 141 is completed (FIG. 13C).

At this time, the air cylinder 146 continues to be actuated until the stopper fixed to the rod of the air cylinder 146 contacts the shock absorber 156. However, since the upper surface 700 of the top ring guides 148 contacts the lower surface of the guide ring 301 to cause the guide stage 141 to be fixed at this position, the air cylinder 146 pushes the spline shaft 142 together with the air cylinder 145 against urging force of the compression spring 152, thus lifting the push stage 143. In this embodiment, the air cylinder 146 is arranged to be further actuated after the top ring guides 148 contact the guide ring 301. The shock generated at this time is absorbed by the spring 152.

After the lifting actuation of the air cylinder 146 is completed, the semiconductor wafer 101 is removed from the top ring 32, and held by the unloading wafer support table 600 (FIG. 13D).

After the semiconductor wafer 101 is held by the unloading wafer support table 600, the pusher 30 starts to be lowered. Then, the unloading wafer support table 600 is transferred together with the polished semiconductor wafer to the rotary transporter 27 (FIG. 13E), and the pusher 30 continues to be lowered and the operation of the pusher 30 is finished by completion of its lowering (FIG. 13F).

The rotary transporter 27 is rotated, and the unloading wafer support table 600 holding the polished semiconductor wafer thereon is located above the lifter 29. Then, the lifter 29 is raised, and receives the unload wafer support table 600 holding the polished semiconductor wafer from the rotary transporter 27. The lifter 29 is further raised to thus locate the semiconductor wafer at a wafer transfer position where the semiconductor wafer is transferred to the reversing device 28.

After the arms of the reversing device 28 hold the semiconductor wafer 101, the lifter 29 is lowered to transfer the unloading wafer support table 600 to the rotary transporter 27. When the lowering of the lifter 29 is completed, the transfer operation of the semiconductor wafer from the top ring 32 to the reversing device 28 is completed.

As described above, according to the present invention, it is possible to shorten the time required to transfer a workpiece to be polished, such as a semiconductor wafer, to the top ring, for thereby greatly increasing the number of processed workpieces per unit time, i.e., throughput.

According to the present invention, when the workpiece is transferred between the rotary transporter and the reversing device, the workpiece is transferred between the support table and the reversing device, and when the workpiece is transferred between the rotary transporter and the top ring, the workpiece is transferred between the support table and the top ring. Therefore, the support table can absorb an impact or a shock on the workpiece generated when transferring, and hence the transfer speed of the workpiece can be increased for thereby increasing throughput.

Further, in the conventional polishing apparatus, the number of top rings is increased and the workpieces are simultaneously polished for thereby increasing throughput. Thus, the workpieces cannot be uniformly polished due to the difference of individual top rings caused by increasing of the top rings. In contrast thereto, in the present invention, by increasing the transfer speed of the workpieces, throughput can be increased.

According to the present invention, the transfer of the semiconductor wafer from the reversing device to the top ring can be performed by the wafer support tables removably held by the respective stages of the rotary transporter. Thus, for example, the transfer of the semiconductor wafer between the lifter and the rotary transporter or between the rotary transporter and the pusher may be eliminated to prevent dust from being generated and prevent the semiconductor wafer from being damaged due to transfer error or clamping error.

In the above-described embodiment, a plurality of wafer support tables are assigned to loading wafer support tables for holding a semiconductor wafer to be polished and unloading wafer support tables for holding a semiconductor wafer which has been polished. Therefore, the semiconductor wafer to be polished is transferred not from the pusher but from the loading wafer support table to the top ring, and the polished semiconductor wafer is transferred from the top ring not to the pusher but to the unloading wafer support table. Thus, the loading of the semiconductor wafer to the top ring, and the unloading of the semiconductor wafer from the top ring are conducted by respective jigs (or components), i.e. the wafer support table, and hence the abrasive liquid or the like attached to the polished semiconductor wafer is prevented from being attached to a common support member for performing loading and unloading the semiconductor wafer. As a result, the solidified abrasive liquid or the like is not attached to the semiconductor wafer to be polished, and does not cause damage to the semiconductor wafer to be polished.

In the embodiment, the support table for loading the workpiece and the support table for unloading the workpiece are separately used. However, a single support table may be used for loading and unloading the workpiece.

Although certain preferred embodiments of the present invention have been shown and described in detail, it should be understood that various changes and modifications may be made therein without departing from the scope of the appended claims.

What is claimed is:

1. A polishing apparatus comprising:

a polishing surface;

a top ring for holding a workpiece and pressing the workpiece against said polishing surface to polish the workpiece;

a rotary transporter having a center of rotation, said rotary transporter being disposed in a position which can be accessed by said top ring;

a plurality of stages positioned on a predetermined circumference from the center of rotation of said rotary transporter;

a plurality of support tables removably held by said respective stages of said rotary transporter for supporting workpieces, respectively; and a pusher for vertically moving one of said plurality of support tables in order to transfer the workpiece between said one of said plurality of support tables and said top ring.

2. A polishing apparatus according to claim 1, further comprising:

a reversing device for reversing the workpiece; and a lifter for vertically moving said one of said plurality of support tables in order to transfer the workpiece from said one of said plurality of support tables to said reversing device.

3. A polishing apparatus according to claim 1, wherein said plurality of said support tables comprise a loading support table for holding the workpiece to be polished and an unloading support table for holding the workpiece which has been polished.

4. A polishing apparatus according to claim 1, wherein said rotary transporter comprises a plurality of guide blocks provided circumferentially at certain intervals on each of said stages for removably holding said support tables, respectively.

5. A polishing apparatus according to claim 4, wherein said guide block has at least one of an inner surface which has a tapered surface for centering action and an outer surface which has a tapered surface for centering action.

6. A polishing apparatus according to claim 1, further comprising:

a rotatable shaft;

wherein said top ring is angularly movable about said rotatable shaft to a position over said polishing surface and a position over one of said stages of said rotary transporter.

7. A polishing apparatus comprising:

a plurality of polishing surfaces;

a plurality of top rings for holding workpieces and pressing the workpieces against said polishing surfaces to polish the workpieces;

rotary transporter having a center of rotation, said rotary transporter being disposed in a position which can be accessed by said top rings;

a plurality of stages positioned on a predetermined circumference from a center of rotation of said rotary transporter;

a plurality of support tables removably held by said respective stages of said rotary transporter for supporting workpieces, respectively; and a pusher for vertically moving one of said plurality of support tables in order to transfer the workpiece between said one of said plurality of support tables and one of said plurality of top rings.

8. A polishing apparatus according to claim 7, further comprising:

a reversing device for reversing the workpiece; and a lifter for vertically moving said one of said plurality of support tables in order to transfer the workpiece from said one of said plurality of support tables to said reversing device.

9. A polishing apparatus comprising:

a polishing surface;

a top ring for holding a workpiece and pressing the workpiece against said polishing surface to polish the workpiece;

a rotary transporter disposed in a position which can be accessed by said top ring;

a plurality of stages positioned on said rotary transporter;

a plurality of support tables removably held by said respective stages of said rotary transporter for supporting workpieces, respectively; and a pusher for vertically moving one of said plurality of support tables in order to transfer the workpiece between said one of said plurality of support tables and said top ring.

10. A polishing apparatus according to claim 9, further comprising:

a reversing device for reversing the workpiece; and a lifter for vertically moving said one of said plurality of support tables in order to transfer the workpiece from said one of said plurality of support tables to said reversing device.

11. A polishing apparatus according to claim 9, wherein said plurality of said support tables comprise a loading support table for holding the workpiece to be polished and an unloading support table for holding the workpiece which has been polished.

12. A polishing apparatus according to claim 9, wherein said rotary transporter comprises a plurality of guide blocks provided circumferentially at certain intervals on each of said stages for removably holding said plurality of support tables, respectively.

13. A polishing apparatus according to claim 9, wherein said guide block has at least one of an inner surface which has a tapered surface for centering action and an outer surface which has a tapered surface for centering action.

14. A polishing apparatus according to claim 9, further comprising:

a rotatable shaft;

wherein said top ring is angularly movable about a rotatable shaft to a position over said polishing surface and a position over one of said stages of said rotary transporter.

15. A polishing apparatus comprising:

a plurality of polishing surfaces;

a plurality of top rings for holding workpieces and pressing the workpieces against said polishing surfaces to polish the workpieces;

a rotary transporter disposed in a position which can be accessed by said top rings;

a plurality of stages positioned on said rotary transporter;

a plurality of support tables removably held by said respective stages of said rotary transporter for supporting workpieces, respectively; and a pusher for vertically moving one of said plurality of support tables in order to transfer the workpiece between said one of said plurality of support tables and one of said plurality of said top rings.

16. A polishing apparatus according to claim 15, further comprising:

a reversing device for reversing the workpiece; and a lifter for vertically moving said one of said plurality of support tables in order to transfer the workpiece from said one of said plurality of support tables to said reversing device.

* * * * *